US005376999A

United States Patent [19]

Hwang

[11] Patent Number: 5,376,999

[45] Date of Patent: Dec. 27, 1994

[54] DEVICE FOR MINIMIZING INTERMEDIATE BELT STRETCH AND SHRINKAGE IN XEROGRAPHIC COPIER

[75] Inventor: Shyshung S. Hwang, Penfield, N.Y.

[73] Assignee: Xerox Corporation, Stamford, Conn.

[21] Appl. No.: 73,210

[22] Filed: Jun. 8, 1993

[51] Int. Cl.[5] ..... G03G 15/14

[52] U.S. Cl. ..... 355/326 R; 355/273; 355/275

[58] Field of Search ..... 355/326 R, 327, 275, 355/273, 277

[56] References Cited

U.S. PATENT DOCUMENTS

| | | | |
|---|---|---|---|
| 4,114,536 | 9/1978 | Kaneko et al. | 355/277 |
| 4,415,257 | 11/1983 | Kopp et al. | 355/277 |
| 4,699,496 | 10/1987 | John et al. | 355/277 |
| 4,796,047 | 1/1989 | Fowlkes et al. | 355/277 |
| 4,984,024 | 1/1991 | Ohkaji et al. | 355/273 |
| 5,309,203 | 5/1994 | Hokari | 355/326 R X |

FOREIGN PATENT DOCUMENTS

| | | |
|---|---|---|
| 3-263072 | 11/1991 | Japan . |
| 5-53448 | 3/1993 | Japan . |

*Primary Examiner*—A. T. Grimley
*Assistant Examiner*—Nestor R. Ramirez
*Attorney, Agent, or Firm*—Oliff & Berridge

[57] ABSTRACT

A xerographic printer or digital copier has an intermediate belt for transferring images from several photoreceptive drums to sheets of paper. The intermediate belt experiences undesired stretching and shrinking which results in the size of the transferred image being distorted and the colors of the transferred image being misregistered. The printer is provided with a plurality of drag inducing members preferably in the form of drag rollers or skid plates which minimize the stretching and shrinking of the intermediate belt by counteracting the belt distorting forces. The magnitude of the drag forces to be applied by each of the drag inducing members can be calculated and the position of each of the drag inducing members can be adjusted according to each of the calculated drag forces.

18 Claims, 5 Drawing Sheets

DEVICE FOR MINIMIZING INTERMEDIATE BELT STRETCH AND SHRINKAGE IN XEROGRAPHIC COPIER

BACKGROUND OF THE INVENTION

1. Field of the Invention

The present invention relates to image forming devices such as xerographic printing and copying machines, and in particular, a device and method for preventing image size distortion and color misregistration of images. The device and method of the present invention compensate for changes in tension in an intermediate image carrying belt which causes the belt to stretch or shrink resulting in image distortion and color misregistration.

2. Relevant Art

Designers of xerographic printers and copiers have generated several solutions to the problems of image size distortion and color misregistration of toned images formed on an intermediate image carrying belt. The intermediate belt; made of a dielectric material, serves as an image carrier. Tension in the intermediate belt varies according to changes in several factors including the contact force between the belt and photoreceptive drums and belt drive rollers, differences in rotating speed of the belt and photoreceptive drums, and misalignment of the belt and photoreceptive drums.

In a monochrome copying mode, stretching of the belt produces an image larger than the original image and shrinking of the belt produces an image smaller than the original image. The amount of change in the size of the image produced depends on the amount of belt stretching or shrinking which varies according to changes in belt tension. In a polychrome copying mode, not only are the images enlarged or reduced as in the monochrome mode, but the images are also subject to color misregistration.

One solution to the above problems is to use a stiffer and thicker belt that is far less susceptible to stretching or shrinking However, the stiffer and thicker belts, made of materials such as stainless steel, more readily propagate motion errors such as those caused by vibration of the belt. These types of motion errors and others are highly detrimental to the image forming process. Thus, the stiffer metal belts are not that desirable.

Another solution to correct image distortion is slip transfer. In polychrome systems, the color registration errors accumulate because of the imperfections in the size and shape of the mechanical parts. To overcome the above problems, a slip transfer is implemented so that the photoreceptive drums are rotated at a speed slightly faster than the rotating speed of the intermediate transfer belt. However, slip transfer can only prevent a limited amount of misregistration and creates additional problems with image smearing, Also, the amount of slip transfer is difficult to control when high-pressure biased transfer is used to transfer images from the photoreceptive drums to the intermediate belt.

SUMMARY OF THE INVENTION

It is an object of the present invention to provide an image forming device that overcomes the above problems with color misregistration and image size distortion of toned images formed on an intermediate or photoreceptive belt.

It is another object of the present invention to provide a device and method for preventing enlarging and shrinking of a monochrome image caused by changes in tension in an intermediate image transfer belt.

It is a further object of the present invention to provide a device and method for preventing image size distortion and color misregistration of a polychrome image caused by changes in tension in an intermediate image transfer belt.

It is yet another object of the present invention to provide a device and method for preventing changes in tension in an intermediate image transfer belt in a tacked transfer xerographic copier from distorting the output images.

It is a further object of the present invention to provide a device and method for preventing changes in tension in an intermediate image transfer belt in a slip transfer xerographic copier from distorting the output images.

It is a further object of the present invention to provide a device and method for minimizing stretching and shrinking of an intermediate or photoreceptive belt to ensure proper reproduction and registration of a toned image.

It is another object of the invention to provide a method and device for ensuring that an intermediate belt continually contacts a plurality of photoreceptive drums with an optimum contact force and contact area.

It is yet another object of the invention to provide a method and device for providing an adjustable drag force on an intermediate or photoreceptive belt to prevent image size distortion and color misregistration.

These and other objects, features and advantages of the invention will be apparent to those skilled in the art from the following detailed description of the invention, when read in conjunction with the accompanying drawings and appended claims.

According to the invention, the tension of an intermediate belt can be maintained at a desired level by providing drag forces on the belt. The drag forces prevent the belt from shrinking and stretching at any of the transfer points between the photoreceptive drums and the intermediate belt. The forces required to prevent stretching and shrinking of the intermediate belt can be applied by drag rollers or skid plates acting on the back side of the belt. By designing these rollers and skid plates with an appropriate coefficient of friction and providing them at an appropriate location along the belt, belt stretch and shrinkage can be minimized to allow for virtually error-free image reproduction. Also, each drag roller and skid plate is preferably provided with a position adjusting device, which allows an operator to move a drag roller or skid plate up or down relative to a photoreceptive drum to ensure proper contact between the belt and drum. The drag roller and skid plate position adjusting device also allows an operator to adjust the drag forces applied to the belt to correct for any changes in belt tension.

BRIEF DESCRIPTION OF THE DRAWINGS

The invention is illustrated in the accompanying drawings, in which.

DETAILED DESCRIPTION OF THE PREFERRED EMBODIMENTS

Figure 1:
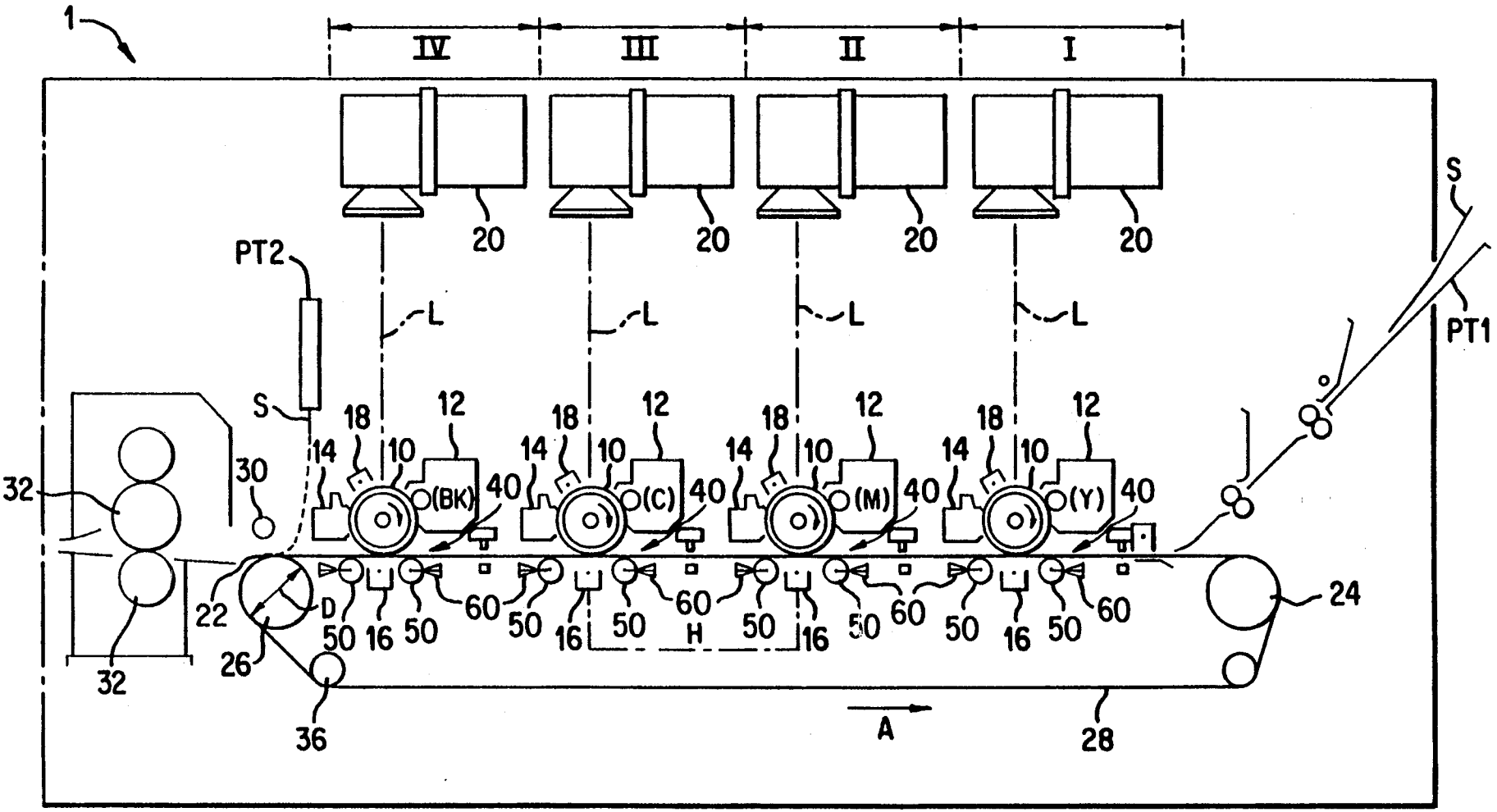
FIG. 1 illustrates a tacked transfer xerographic printing or digital copying device with an intermediate transfer belt having a first embodiment of the drag force applying device of the present invention.

An example of a tacked transfer xerographic copier that is susceptible to problems with belt stretching and shrinking is shown in FIG. 1. The copier 1 shown in FIG. 1 is a tandem engine architecture printer preferably comprising four complete xerographic engines, each producing its own color image. The xerographic engines shown are electrophotographic laser beam printing mechanisms I–IV which are substantially identical in construction. Each printing mechanism includes a photoreceptive drum 10, a laser beam source 20, a charging device such as a corotron 18, a cleaning station 14, a transfer station 16 and a developing station 12. In each printing mechanism I–IV, a laser beam scanner 20 oscillates a laser beam L along the surface of a photoreceptive drum 10 and forms a latent image on the drum 10 corresponding to an electrical or an optical input. Developing stations 12 of printer mechanisms I–IV develop the latent images using yellow (Y), magenta (M), cyan (C) and black (BK) developing toners. Transfer device 16 charges an intermediate belt 28 or a paper sheet S on belt 28 so that belt 28 or sheet S receives an image from each of the photoreceptive drums 10.

Belt 28 is fitted around driving rollers 24 and/or 26 and tensioning roller 36. Tensioning roller 36 provides an initial tension to belt 28 to ensure that belt 28 can be rotated by rollers 24 and/or 26. Driving rollers 24, 26 rotate intermediate belt 28 to convey the belt in the direction shown by arrow A. As belt 28 contacts each of the photoreceptive drums 10 at each of a plurality of transfer Zones 40, the yellow, magenta, cyan and black images are transferred to belt 28 or can be transferred directly to a sheet of paper S fed in from a paper tray PT1.

If the images are first transferred to intermediate belt 28, then the paper feeding is delayed until all four color images are transferred to belt 28. Then a sheet S is fed in from a paper tray PT2 and contacts the image on intermediate belt 28 at a transfer nip 22 formed by a transfer roller 30 and belt driving roller 26. If the color images are to be transferred directly to a sheet S, then the sheet S is fed in and transported by belt 28. The sheet being fed on belt 28 receives each color image successively as the sheet passes each transfer zone 40. After the image is transferred from photoreceptive drums 10 to the intermediate belt 28 and then to sheet S or directly from photoreceptive drums to sheet S, the paper is fed out by fuser rollers 32.

In the tacked transfer device of FIG. 1, good color registration with tacked transfer requires a highly precise geometrical match between image forming components which therefore demands excellent alignment and extremely precise manufacturing of the image forming components. This degree of, required manufacturing and assembling accuracy is costly and difficult to achieve.

Even if the components are manufactured and assembled with great precision, wearing of the components may still cause problems with the intermediate belt 28 stretching and shrinking. Also, because stretching and shrinking can be caused by differences in speeds between drums 10 and belt 28, improper alignment of drums 10 and belt 28, or improper alignment and rotational speed of other rollers 24, 26, 36, it is very difficult and costly to continuously compensate for these causes.

A much easier and more effective solution is to provide drag rollers 50, preferably positioned on either side of each of the photoreceptive drums 10, to ensure that belt 28 does not stretch or shrink at the critical transfer zones 40 between each of photoreceptive drums 10 and belt 28. Drag rollers 50 also ensure that intermediate belt 28 maintains sufficient contact with each of the drums 10 to obtain accurate and error free image transfer. When the image is transferred directly to the paper, rollers 50 also ensure sufficient contact between sheet S and drums 10.

Each of drag rollers 50 may preferably be provided with a position adjusting device 60 which allows the position of each roller 50 to be adjusted to compensate for changes in belt tension and other factors affecting image transfer. By adjusting the position of each roller 50, the amount of drag force provided by each roller 50 and the amount of contact area between belt 28 and each of drums 10 can be adjusted. The exact operation of position adjusting device 60 and the process for determining the amount of drag force to be provided by each drag roller 50 will be described below.

Figure 2:
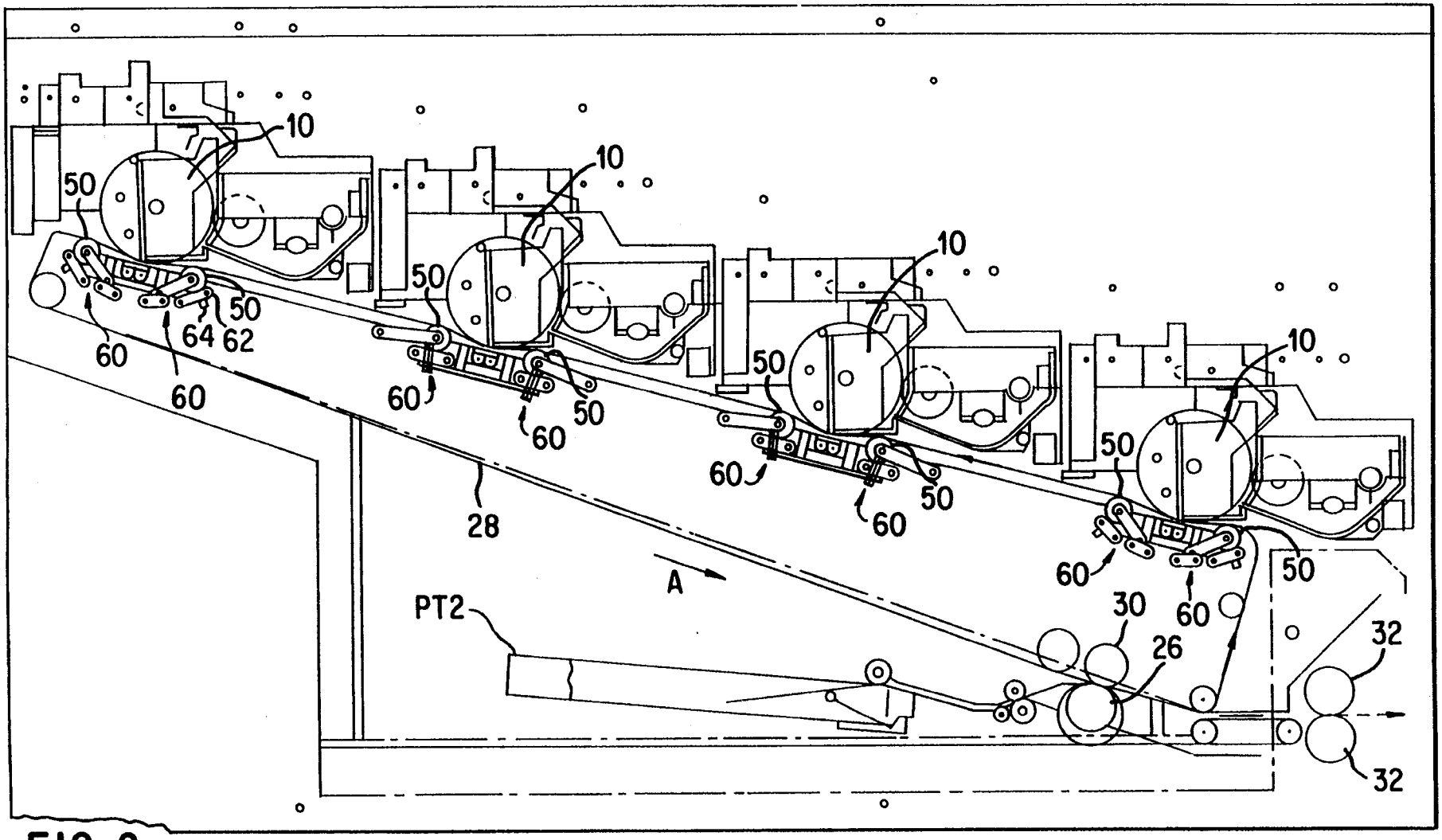
FIG. 2 illustrates a slip transfer xerographic copying device with an intermediate transfer belt having a first embodiment of the drag force applying device of the present invention.

FIG. 2 shows a slip transfer xerographic copier having many of the same structural components as in FIG. 1. The same reference numerals used in FIG. 1 are used in FIG. 2 for the same structural elements. In the device of FIG. 2, the four color images are transferred directly to intermediate belt 28. Also, photoreceptive drums 10 are driven at a speed slightly faster or slower than the speed of belt 28 to introduce a slip transfer and alleviate the need for Strict manufacturing precision of the image forming components. The range of speed difference is preferably between 0.02% and 0.3%. While this is an improvement over the device of FIG. 1, the slip transfer creates a shearing force between each of drums 10 and belt 28 thereby ensuring an undesired change in belt tension. Furthermore, the slip transfer only allows a limited amount of laxity in precision tolerance and may lead to image smearing. If the belt tension increases as it contacts a photoreceptive drum 10 or other surface, the belt will stretch according to the degree of strain in the belt and other factors. The belt stretch will contribute to the color misregistration as belt 28 receives images from the photoreceptive drums 10.

To remedy the above problems, the device of FIG. 2 has a plurality of drag rollers 50 positioned at each printing station. Drag rollers 50 are provided in each transfer zone 40 so as to contact the backside of intermediate belt 28 and the force differentials can be accommodated by a dc motor, servo motor or brake mechanism (not shown). The size, number and location of drag rollers 50 can vary according to the length of belt 28, the belt material, the number and size of photoreceptive drums 10 and various other factors. However, rollers 50 must be designed and located so as to prevent any change in belt tension in each of the spaces between photoreceptive drums 10 and belt contact points and ensure sufficient contact area between each of drums 10 and intermediate belt 28. By preventing any change in belt tension in areas between photoreceptive drums 10, belt 28 does not shrink or stretch and thus, no image distortion or color misregistration occurs. By ensuring sufficient contact area, accurate and error-free image transfer is assured.

Figure 3:
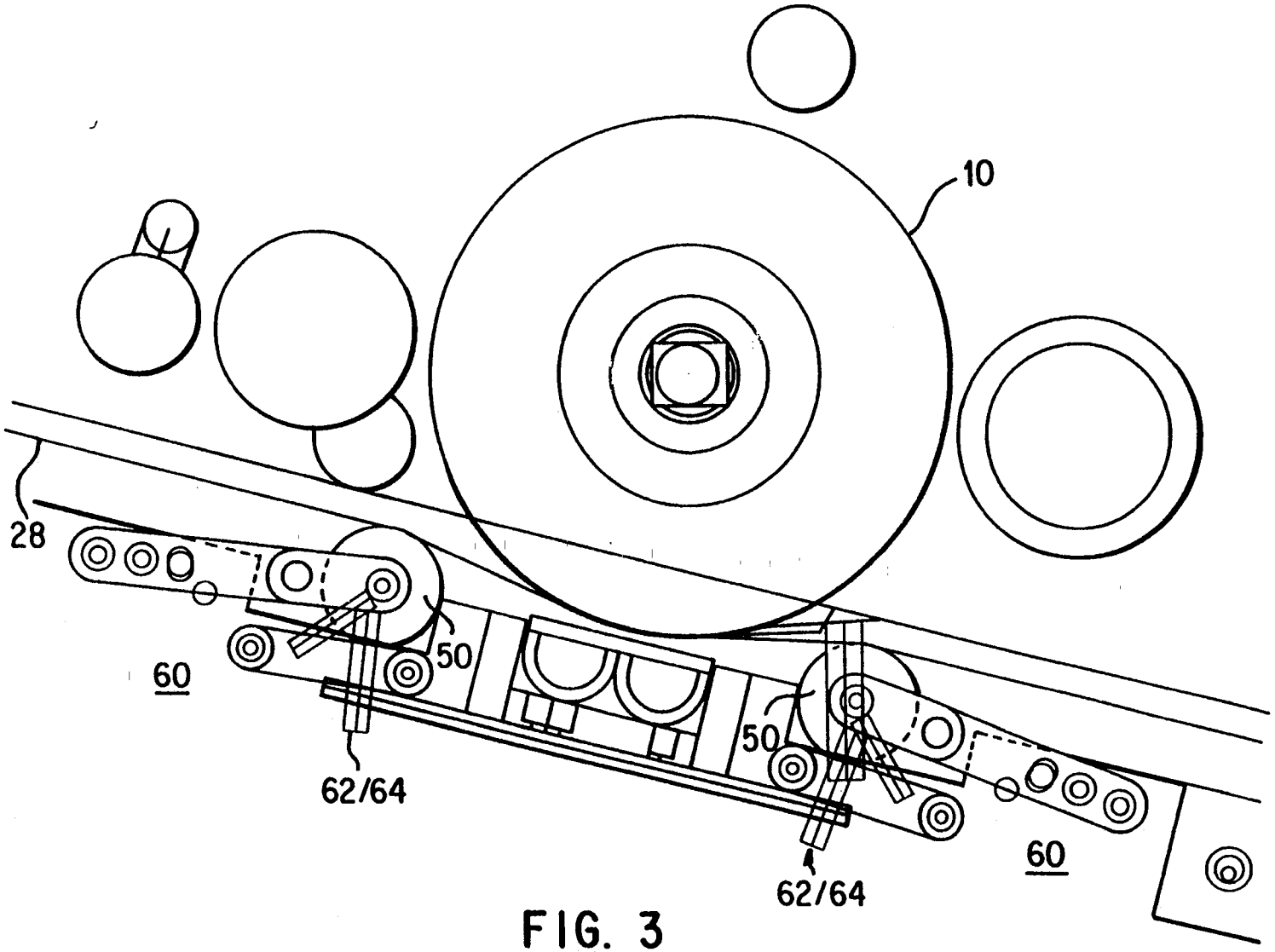
FIG. 3 is an exploded view of the position adjustment device shown in FIG. 2.

To allow for some flexibility in the design and arrangement of drag rollers 50, each of the drag rollers 50 is preferably provided with a position adjusting device 60 which preferably includes a set screw 62 and/or micrometer 64, shown in FIG. 3. To increase a drag force provided by a drag roller 50 on belt 28, set screw 62 is manually turned a predetermined amount to move roller 50 upwardly towards photoreceptive drum 10. This also results in an increase in the amount of contact area between belt 28 and drum 10. To decrease the tension and contact area, set screw 62 is manually turned a predetermined amount to move roller 50 downwardly away from photoreceptive drum 10. A micrometer 64 is preferably used to ensure that each of the rollers 50 is positioned correctly. The micrometer 64 is preferred to adjust and to show the exact roller position. The correlation between each roller position and the magnitude of the contact area and drag force applied by each roller can be determined beforehand and stored in a CPU 80 shown in FIG. 4.

Also, an automatic drag roller position adjusting device may be provided whereby the amount of change from the present roller position setting can either be input by an operator or determined by a CPU 80. Then, position adjusting device 60 could automatically adjust roller 50 position by rotating a lead screw, used in place of manual set screw 62 or micrometer 64, a certain number of revolutions. The CPU 80 could determine the amount of positional change based on the drag force determined from the equation described below and inform an operator of the desired position of each roller 50. The operator could then enter the desired position determined by the CPU 80 or some other desired position into a control interface and the CPU 80 could automatically adjust each roller to the position entered by an operator. A position adjusting device 60 could also be set up so that the CPU 80 automatically determines the correct position of each drag roller 50 and automatically adjusts each roller 50 without first informing an operator of the desired position for each of the drag rollers 50.

Figure 4:
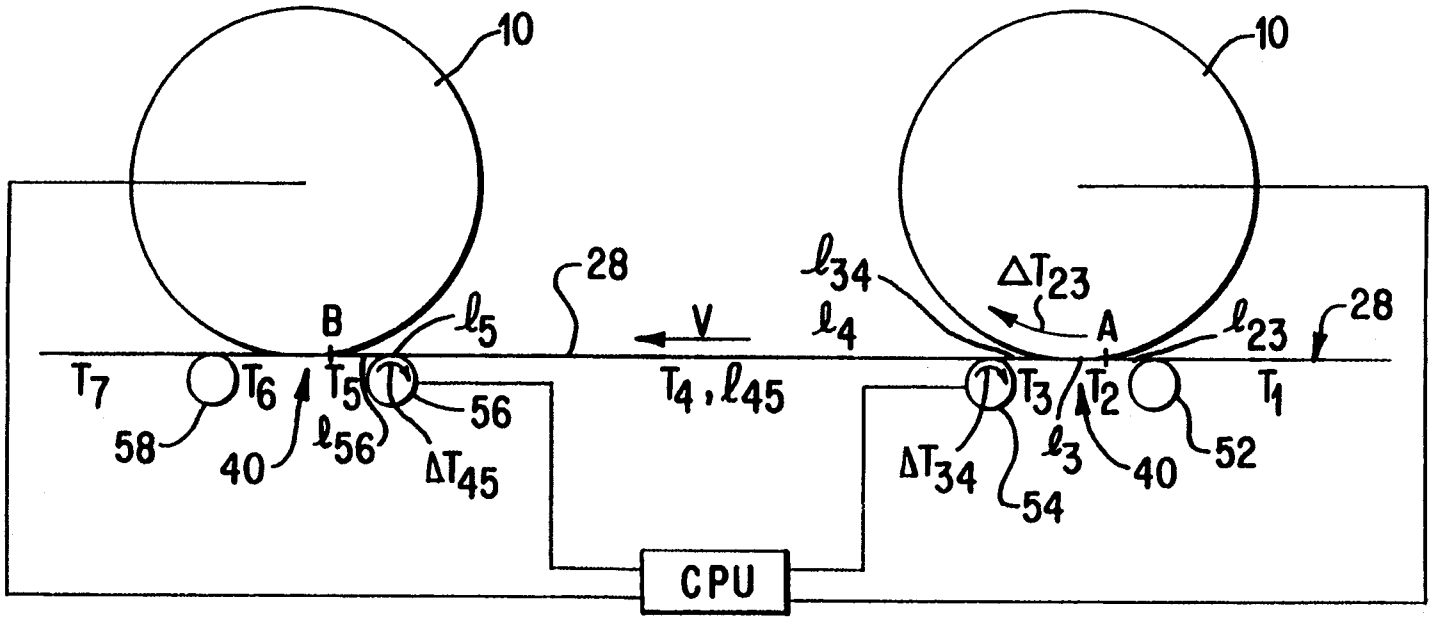
FIG. 4 is an exploded view of the drag force applying device shown in FIG. 2.

Drag rollers 50 operate as shown in FIG. 4. Each photoreceptive drum 10 is preferably provided with a pair of drag rollers 50 located on either side of drum 10. For the purpose of explanation only, one transfer zone 40 will be discussed but it is understood that each of a plurality of transfer zones 40 experiences tension and requires similar corrective drag forces to be applied by drag rollers 50.

In normal operation, a shearing force is created between each of photoreceptive drums 10 and belt 28. The shearing force $\Delta T_{23}$ is caused by differences in speeds between drum 10 and belt 28, improper alignment of drum 10 and belt 28, and improper alignment and rotational speed of other rollers 24, 26, 36 described in the discussion of FIG. 1. In the case where a slip transfer is imparted by rotating each of drums 10 at a speed slightly higher than the speed of belt 28 as in FIG. 2, the shearing force $\Delta T_{23}$ depends on the degree of slip and the biased transfer voltage as well as the factors discussed above. As seen in FIG. 4, the shearing force $\Delta T_{23}$ acts on belt 28 at each transfer zone 40.

The shearing force $\Delta T_{23}$ acts along a wrap 13 which is equal to the amount of belt surface which wraps around a small portion of the circumference of photoreceptive drum 10. A tension $T_2$ is created in a span $I_{23}$ of belt 28 between drag roller 52 and the contact point of wrap $I_3$ or point A. Drag roller 54 contacts belt 28 at a wrap $I_4$ which is equal to the amount of belt surface that wraps around a small portion of the circumference of drag roller 54. A tension $T_3$ is created in the span $I_{34}$ of belt 28 between drag roller 54 and the contact point of wrap $I_3$. In the span $I_{45}$ between rollers 54 and 56, a tension $T_4$ is created. Drag roller 56 contacts belt 28 at wrap $I_5$ which is equal to the amount of belt surface 28 that wraps around a small portion of the circumference of drag roller 56. A tension $T_5$ is created in the span $I_{56}$ of belt 28 between roller 56 and the contact point B. Tensions $T_6$ and $T_7$ are created similar to tensions $T_3$ and $T_4$.

To overcome the shearing force $\Delta T_{23}$ at each transfer zone 40, a drag force $\Delta T_{34}$ is created by roller 54 rubbing against the backside of belt 28 at wrap $I_4$ and a drag force $\Delta T_{45}$ is created by roller 56 rubbing against the backside of belt 28 at wrap $I_5$. Both forces $\Delta T_{34}$ and $\Delta T_{45}$ are provided in a direction opposite to the direction of force $\Delta T_{23}$. Application of forces $\Delta T_{34}$ and $\Delta T_{45}$ ensure that there is no change in belt tension between points A and B in between the two photoreceptive drums shown. As shown in FIG. 2, each of the photoreceptive drums 10 can be provided with drag rollers 50 to apply a predetermined drag force to belt 28 to ensure that belt tension remains constant between the photoreceptive drums.

The magnitude of forces $\Delta T_{34}$ and $\Delta T_{45}$ to be applied to belt 28 can be determined based on the magnitude of shearing force $\Delta T_{23}$. The shearing force $\Delta T_{23}$ can be determined preferably by one of dynamic torque measurements, belt surface strain measurements and photoelastic methods. Dynamic torque measurements of the frictional shearing force can be accomplished using the following equation:

$$\Delta T_{23} = \Delta \text{Torque}/R \quad (1)$$

$\Delta$Torque = torque difference
R = photoreceptive drum radius

Once the magnitude of the shearing force $\Delta T_{23}$ is known, the magnitude of forces $\Delta T_{34}$ and $\Delta T_{45}$ can be determined based on the strain of the tensioned intermediate belt 28. The strain of the belt can be expressed as $$\epsilon = \frac{\Delta L}{L} = \frac{\Delta T}{Eh}$$

where
$\Delta L$ = stretch
L = length or section of the belt under tension
$\Delta T$ = belt tension variation per unit belt width
E = Young's modulus
h = belt thickness
The stretch of the belt is, therefore:

$$\Delta L = L\left(\Delta \frac{T}{Eh}\right)$$

Belt 28 shown in FIG. 4 is under various tensions $T_1$–$T_7$. The total tension in the various sections of the belt 28 can be approximated as follows:

$$\Delta L = \frac{1}{Eh}(\Sigma l_n \Delta T_n) \quad (3)$$

From FIG. 4, the tensions of the belt can be expressed as $$T_3 = T_2 - \Delta T_{23}$$

$$T_4 = T_3 + \Delta T_{34} = T_2 + (\Delta T_{34} - \Delta T_{23}) \quad (4)$$

$$T_5 = T_4 + \Delta T_{45} = T_2 + (\Delta T_{45} + \Delta T_{34} - \Delta T_{23})$$

The stretch of the belt from point A to point B can be estimated from $$\Delta L_{AB} = \frac{1}{Eh}\{l_3 \times 0.5(T_3 - T_2) + l_{34}(T_3 - T_2) + l_4 \times 0.5(T_4 - T_2) + l_{45}(T_4 - T_2) + l_5 \times 0.5(T_5 - T_2) + l_{56}(T_5 - T_2)\} \quad (5)$$

Substituting Equation (4) into Equation (5), one obtains $$\Delta L_{AB} = \frac{1}{Eh}\{\Delta T_{34}(0.5l_4 + l_{45} + l_5 + 2l_{56}) - \Delta T_{23}(0.5l_3 + l_{34} + 0.5l_4 + l_{45} + 0.5l_5 + l_{56})\} \quad (6)$$

assuming $\Delta T_{45} = \Delta T_{34}$. To minimize the belt stretch between A and B, we can set Equation (6) equal to zero, which gives $$\Delta T_{45} = \Delta T_{34} = \frac{0.5l_3 + l_{34} + 0.5l_4 + l_{45} + 0.5l_5 + l_{56}}{0.5l_4 + l_{45} + l_5 + 2l_{56}}(\Delta T_{23}) \quad (7)$$

These are the desired drag forces $\Delta T_{34}$ and $\Delta T_{45}$ to be applied by drag rollers 54 and 56 to compensate for the shearing force $\Delta T_{23}$. If the direction of the shearing forces are reversed, the direction of each of the drag forces is reversed. The equations described above can be used to determine the exact force to be applied by each of the remaining drag rollers 50 at each of the remaining transfer zones 40. By determining the optimum drag force to be applied by each drag roller 50, stretching and shrinking of belt 28 can be prevented and therefore, image size distortion and color misregistration can be eliminated.

Figure 5:
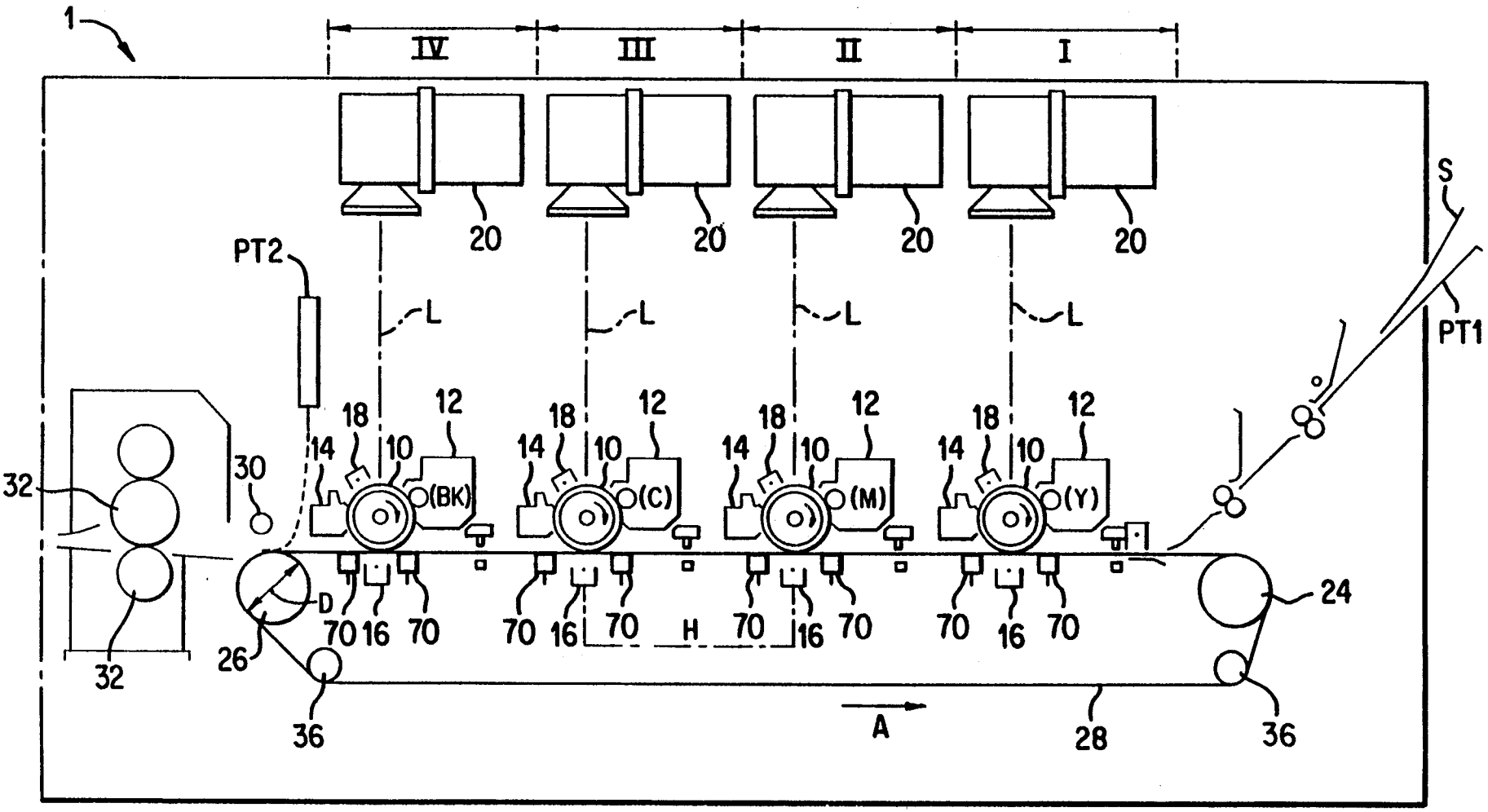
FIG. 5 illustrates a xerographic copying device with an intermediate transfer belt having a second embodiment of the drag force applying device of the present invention.

Instead of the drag rollers 50 shown in FIGS. 1–4, the belt stretch and shrinkage prevention device of the present invention can also be achieved using skid plates 70 shown in FIG. 5. The geometry, location and frictional coefficient of surface friction of skid plates 70 can be designed according to the particular xerographic printing system in which the plates are implemented. The design constraints required for skid plates 70 can be relaxed by providing each skid plate 70 with the position adjusting devices 60 described above. Skid plates 70 apply a drag force to belt 28 in the same way drag rollers 50 apply forces. The magnitudes of the forces applied by skid plates 70 can also be determined using the above equations.

Although the inventions has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed:

I claim:

1. A xerographic printer comprising:

a plurality of photoreceptive drums;

a plurality of latent image forming devices for forming latent images on each of the plurality of photoreceptive drums;

a plurality of developer units for developing a plurality of color images on said plurality of photoreceptive drums;

an intermediate image transferring belt contacting each of the photoreceptive drums so as to receive an image contained thereon;

at least one belt driving roller for rotating said intermediate belt;

tensioning rollers for providing the intermediate belt with an initial tension to allow the belt to be rotated by said at least one belt driving roller;

a paper feeder for feeding paper from a paper supply to contact said intermediate belt along a paper feeding path;

a plurality of drag force applying members contacting said intermediate belt for applying a drag force on the intermediate belt, wherein drag forces applied by said drag force applying members are sufficient to prevent stretching and shrinking of the intermediate belt; and a position adjuster for adjusting a position of each of the drag force applying members to change a magnitude of the drag force applied on the intermediate belt.

2. The printer of claim 1 further comprising a drag force determining device for determining an amount of drag force to be applied by each of the drag force imparting members to prevent stretching and shrinking of the intermediate belt.

3. The printer of claim 2 wherein said position adjuster adjusts the position of each of said drag force applying members according to the drag force determined by said drag force determining device.

4. The printer of claim 3, wherein said position adjuster comprises at least one of a set screw and a micrometer.

5. The printer of claim 1, wherein said drag force applying members comprise a plurality of drag rollers, said plurality of drag rollers contacting said intermediate belt on a back side of said intermediate belt.

6. The printer of claim 5, wherein each of the photoreceptive drums are rotated at a predetermined speed faster than the rotating speed of the intermediate belt to create a shearing force between the drums and the belt, said printer further comprising a device for applying the plurality of drag rollers to said intermediate belt and rotating each of said drag rollers to produce a drag force equal to said shearing force and in a direction opposite to a direction of application of the shearing force.

7. The printer of claim 5, wherein at least two drag rollers are provided for each photoreceptive drum, each of said photoreceptive drums are arranged to contact said intermediate belt at a transfer point, one of said at least two drag rollers being located on one side of said transfer point and the other of said at least two drag rollers being located on the other side of said transfer point.

8. The device of claim 1, wherein said drag force applying members comprise a plurality of skid plates contacting a back side of said intermediate belt.

9. An apparatus for preventing stretching and shrinking of an intermediate belt in a xerographic copier comprising:

tension rollers for providing the intermediate belt with an initial tension;

drag force applying means contacting the intermediate belt for applying a drag force to the belt to prevent stretching and shrinking of the intermediate belt;

belt tension determining means for determining a tension in the intermediate belt at a plurality of points on the belt;

drag force determining means for determining an amount of the drag force to be applied by said drag force applying means according to the tension determined by said tension determining means; and a position adjusting device for adjusting a position of the drag force applying means to change a magnitude of the drag force applied onto the intermediate belt.

10. The apparatus of claim 9, wherein the position adjusting device adjusts the position of said drag force applying means based on the amount of the drag force determined by the drag force determining means.

11. The apparatus of claim 9, wherein said drag force applying means comprises a plurality of drag rollers.

12. The apparatus of claim 9, wherein said drag force applying means comprise a plurality of skid plates.

13. The apparatus of claim 10, wherein said position adjusting device comprises at least one of a set screw and a micrometer.

14. A method of preventing stretching and shrinking of an intermediate belt in a xerographic printer comprising the steps of:

determining an amount of tension change in the intermediate belt;

determining a plurality of drag forces to be applied to a plurality of points on said intermediate belt to offset a determined tension change; and applying the plurality of drag forces determined in said drag force determining step to the plurality of points on the intermediate belt.

15. The method of claim 14, wherein the drag force is applied by a plurality of drag force applying members, the method further comprising the method step of:

adjusting a position of at least one of the rag force applying members to change the magnitude of the drag force.

16. The method of claim 14, wherein said tension change determining step further comprises determining an amount of tension at a plurality of points on the intermediate belt.

17. The method of claim 15, wherein said drag applying members comprise a plurality of rotatable drag rollers, the adjusting step further comprising the steps of applying each of said plurality of drag rollers to said intermediate belt and rotating each of said drag rollers to produce a drag force in a direction opposite to a direction of a distorting force of the intermediate belt to overcome a tension change determined in said tension determining step.

18. The method of claim 15, wherein said drag force applying members comprise a plurality of skid plates

* * * * *